United States Patent [19]

Marklund et al.

[11] 4,348,145

[45] Sep. 7, 1982

[54] WOOD COMPARTMENT

[75] Inventors: Erland Marklund, Skellefteå; Lars Lindström, Byske, both of Sweden

[73] Assignee: Renholmens Mekaniska Verkstad AB, Byske, Sweden

[21] Appl. No.: 48,581

[22] Filed: Jun. 13, 1979

[30] Foreign Application Priority Data

| | | | |
|---|---|---|---|
| Jun. 16, 1978 | [SE] | Sweden | 7806953 |
| Sep. 26, 1978 | [SE] | Sweden | 7810092 |
| Jun. 8, 1979 | [SE] | Sweden | 7905011 |

[51] Int. Cl.[3] ..... B07C 5/14

[52] U.S. Cl. ..... 414/288; 414/268

[58] Field of Search ..... 414/266, 267, 268, 269, 414/564, 288; 294/74–77; 209/517–521

[56] References Cited

U.S. PATENT DOCUMENTS

| | | | |
|---|---|---|---|
| 3,776,379 | 12/1973 | Harvey | 209/518 |
| 4,098,407 | 7/1978 | Moore | 209/517 |
| 4,104,156 | 8/1978 | Fletcher | 209/521 |

FOREIGN PATENT DOCUMENTS

| | | | |
|---|---|---|---|
| 367931 | 6/1974 | Sweden | 414/268 |
| 405815 | 1/1979 | Sweden | 414/268 |
| 410149 | 10/1979 | Sweden | 414/268 |

*Primary Examiner*—Robert G. Sheridan

*Attorney, Agent, or Firm*—Cushman, Darby & Cushman

[57] ABSTRACT

Apparatus for handling elongated objects such as pieces of wood includes at least one elongated flexible member for forming the bottom and sides of an object-handling compartment having a longitudinal dimension and a transverse dimension, the flexible member having a first end and a free end; a coiling device associated with the first end of the flexible member for winding up and unwinding the flexible member; an attaching device at the free end of the flexible member; an attaching mechanism operable for selectively being connected to and disconnected from the attaching device whereby when the attaching device and the attaching mechanism are connected, the flexible member can be suspended from its ends to form the compartment and whereby the attaching device can be disconnected from the attaching mechanism to loosen the flexible member to enable emptying of the compartment; and a device arranged after loosening of the flexible member to introduce the flexible member in the attaching mechanism so as to bring the attaching device by winding of the flexible member onto the coiling means, to retaining engagement with the attaching mechanism.

10 Claims, 14 Drawing Figures

WOOD COMPARTMENT

Figure 1:
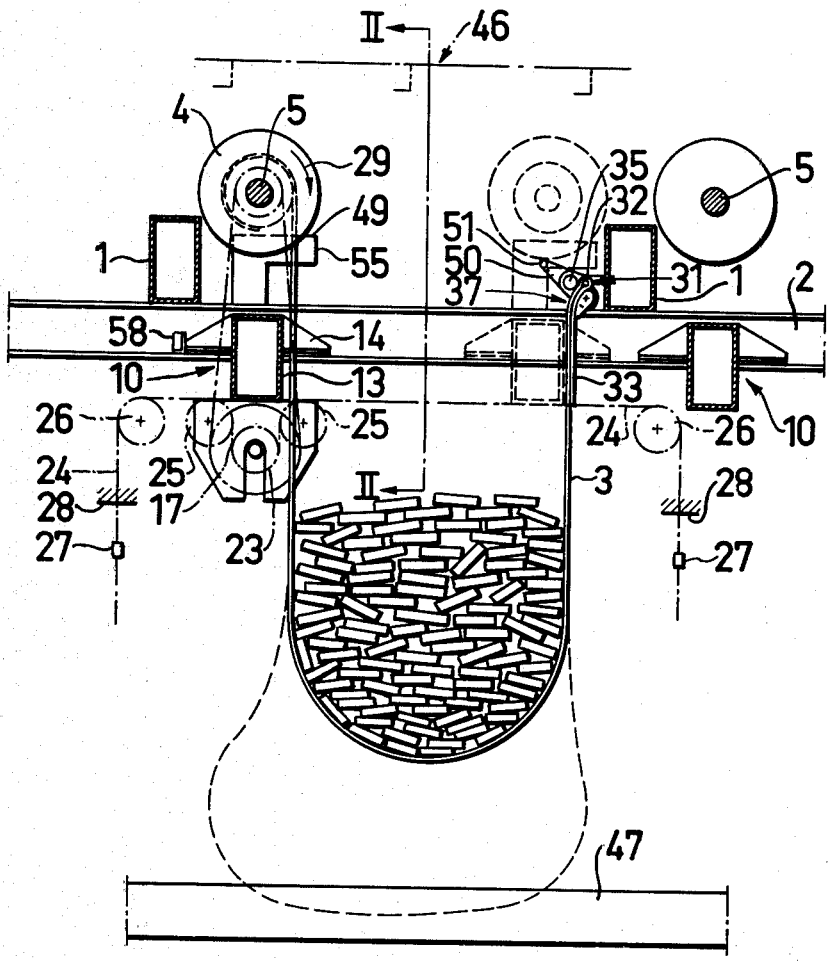

This invention relates to a wood compartment of the type e.g. included in wood sorting works and containing at least two flexible support means in the form of bands, lines, chains or the like, which are parallelly suspended in the latitudinal direction of the compartment, form bottom and sides of the compartment, can be rolled off and onto respective drums and are loosely connected to a mechanism of attachment with their free end to enable emptying of the compartment by loosening said end from the mechanism of attachment.

Such wood compartments are previously known e.g. from Swedish lay-open prints Nos. 347 720 and 367 931 and comprise, as stated above, flexible support means in the form of a mat or a band which can be lowered by being rolled off their drums in order to make it possible to keep the drop of incoming wood pieces substantially at a constant height and in order that the wood might be gently placed at emptying of the compartment on a transport means under the compartment. All this is used to avoid damage to the wood to the utmost possible extent.

At this known type of wood compartments there are certain difficulties to pull out the bands after emptying the compartment without these sticking in the wood pieces and bringing these to a state of disorder, and this is due to the fact that at these known wood compartments relatively big T-shaped means of attachment are required at the ends of the bands for attaching and suspension of the bands in the attaching mechanism.

There is another disadvantage with these known wood compartments, i.e. after attaching the bands in the mechanism it is difficult to get the bands to lie on the same level.

Moreover, another disadvantage is the relatively long time required to restore the compartment after emptying, which is due to the fact that the whole band length must be uncoiled before the free end of the band can again be attached in its means of attachment, and owing to this an increased number of the necessary compartments in a sorting works of a definite capacity may be necessary, and in this way the plant as such will also be more expensive.

Therefore it is the object of the present invention to remove the above disadvantages and other shortcomings, with which known wood compartments of the aforesaid type are encumbered, and thus to provide a wood compartment of the indicated type which is safe in operation and constituted so that it can be rapidly restored after emptying and the bands of which forming bottom and sides can be pulled out after emptying of the compartment and be uncoiled without sticking in the timber delivered from the compartment and bringing this into disorder.

This object is achieved by the wood compartment of the present invention being provided with the characteristic features set out in the claims, and an essential feature of this invention is the insertion of the bands of the compartment in the attaching mechanism at an early stage and long before the means of attachment of the bands are brought to a retaining engagement with the same.

Figure 2:
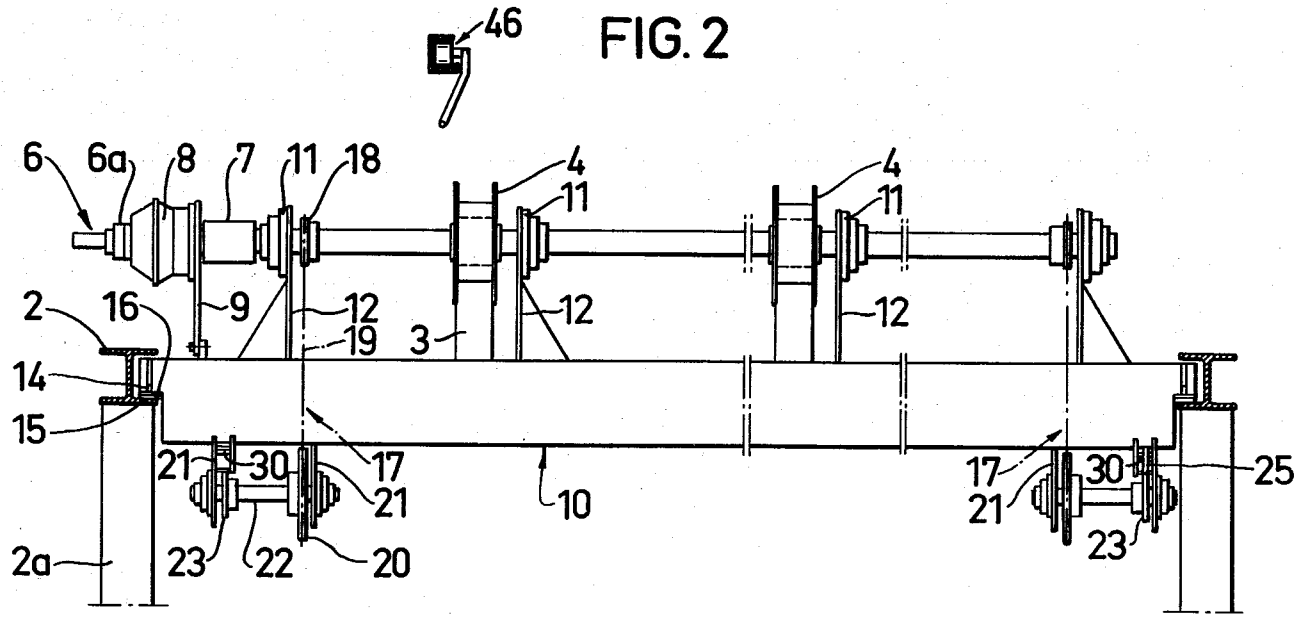
Figure 3:
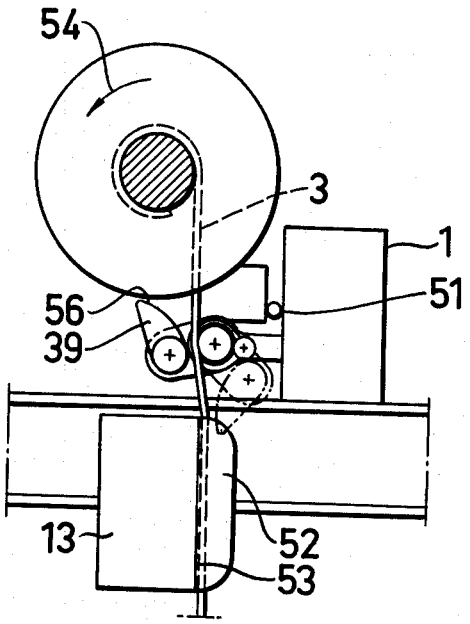
Figure 4:
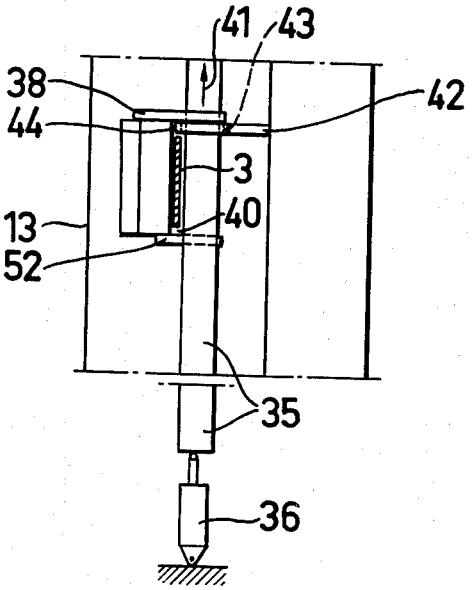
Figure 5:
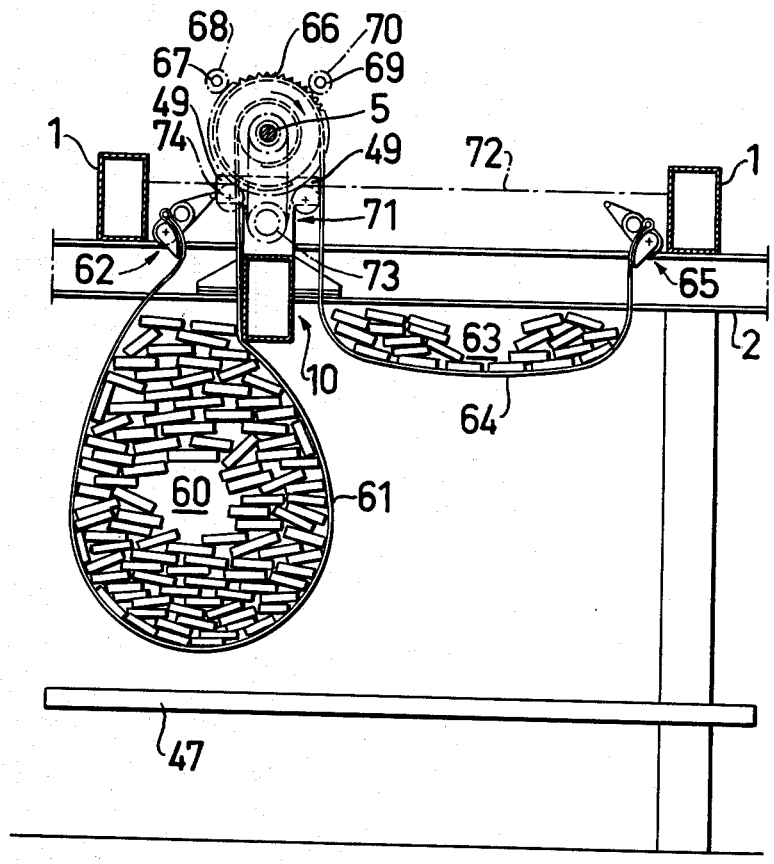
Figures 6, 7:
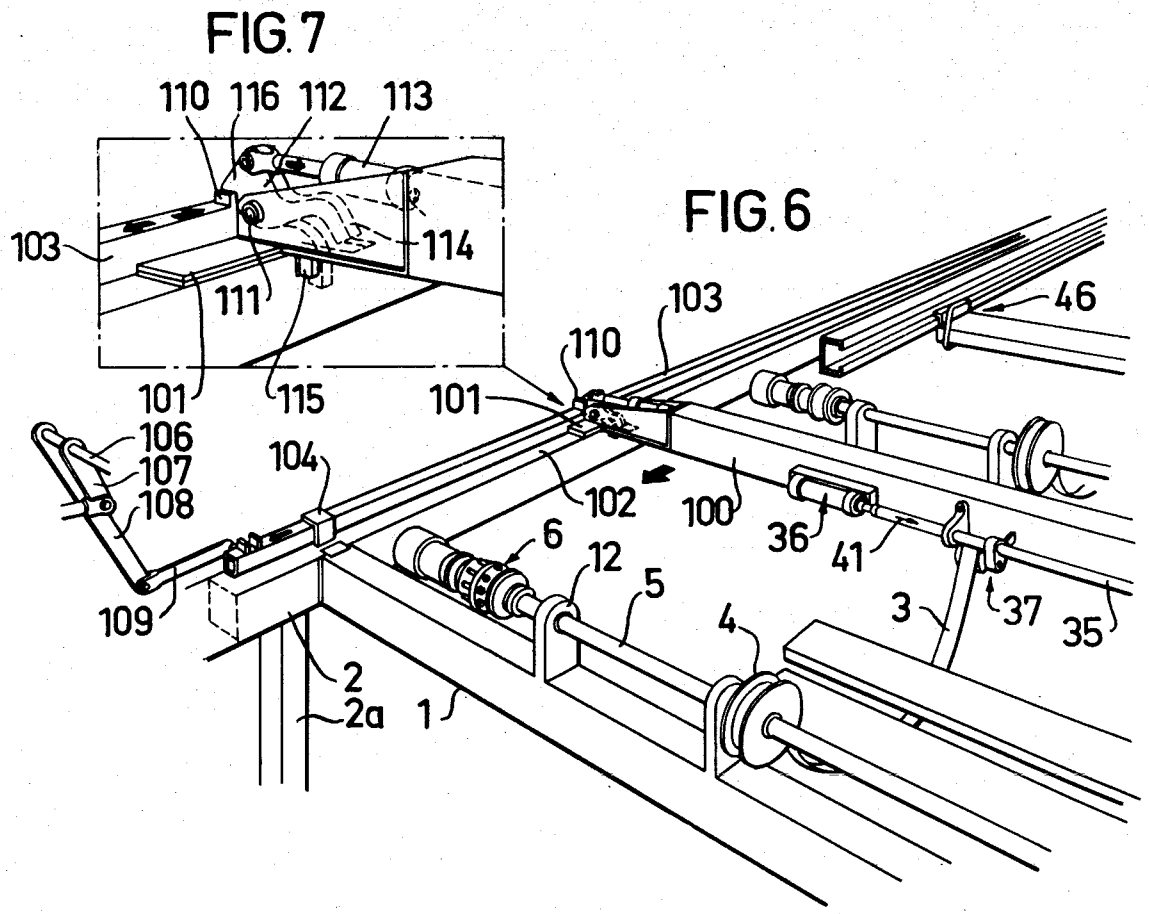
Figure 8:
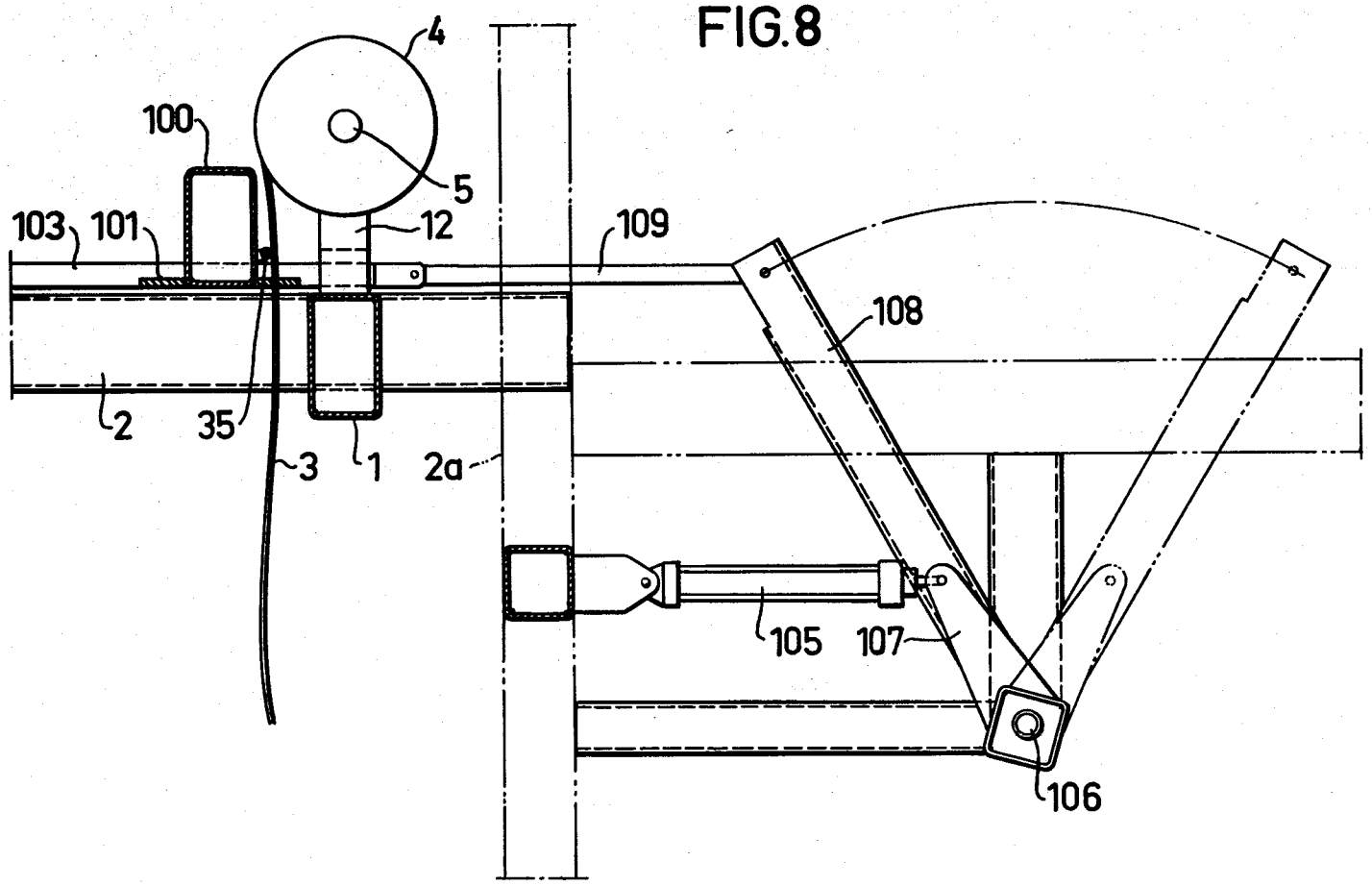
Figure 9:
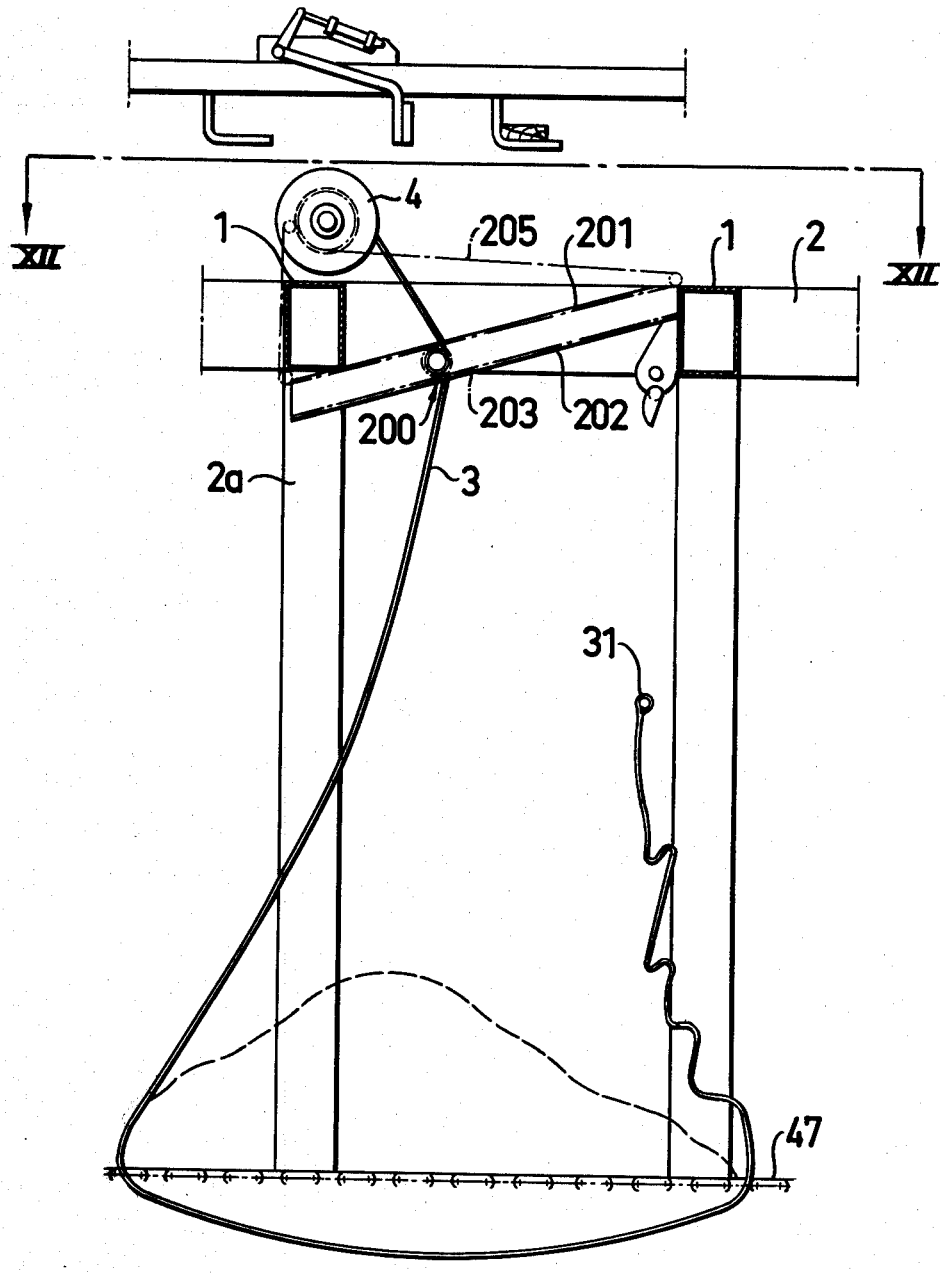
Figure 10:
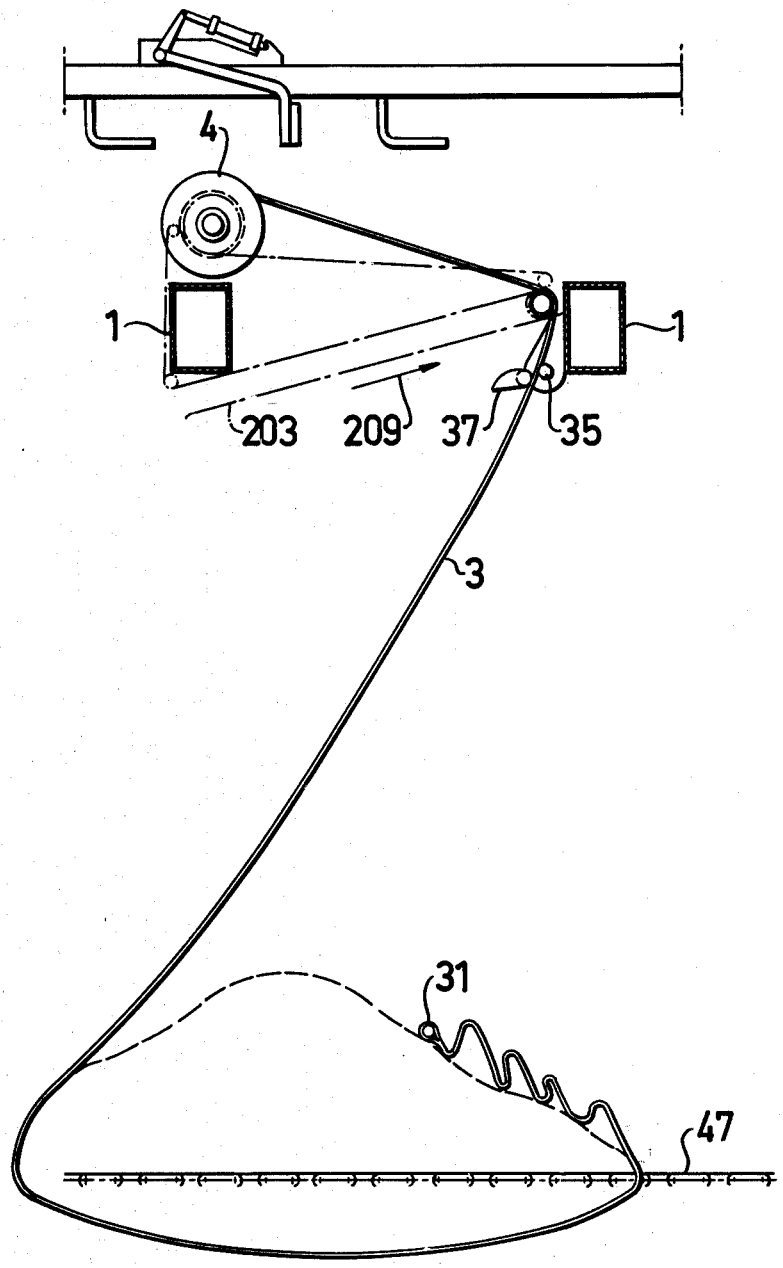
Figure 11:
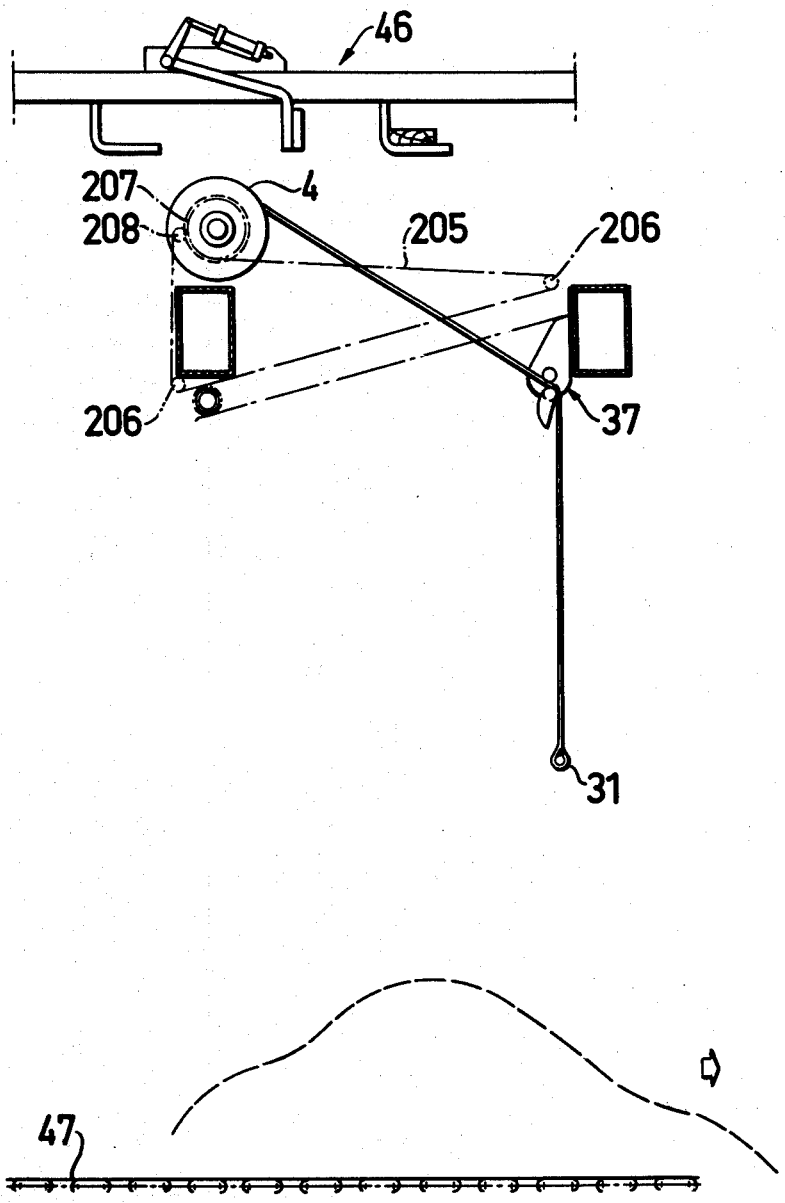
Figure 12:
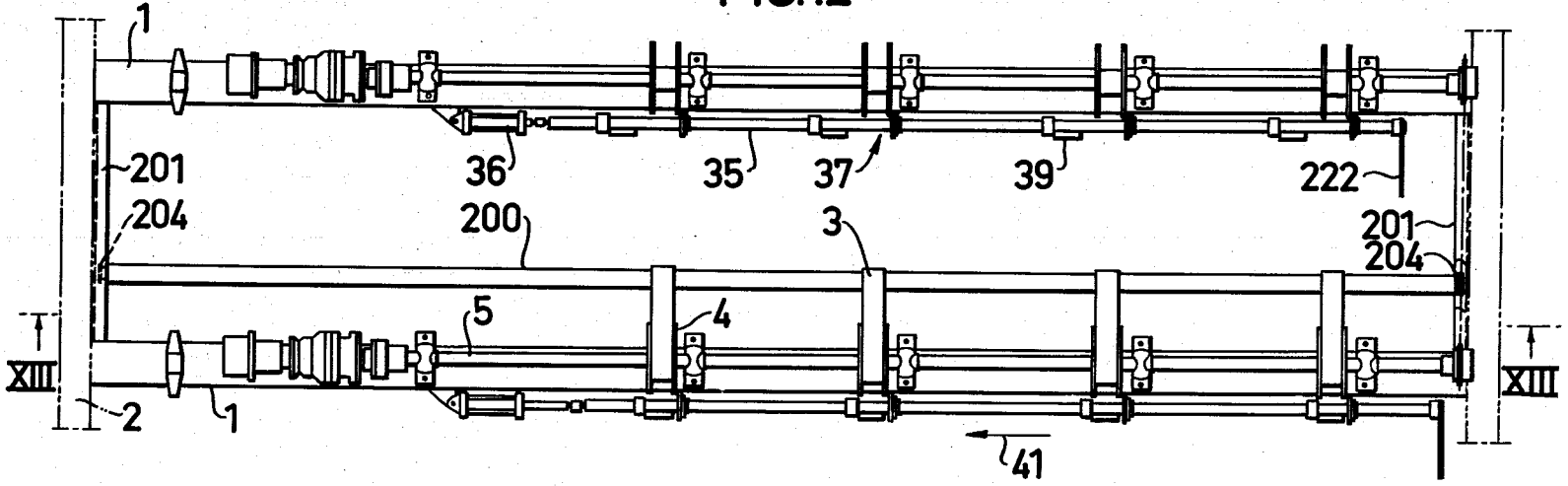
Figure 13:
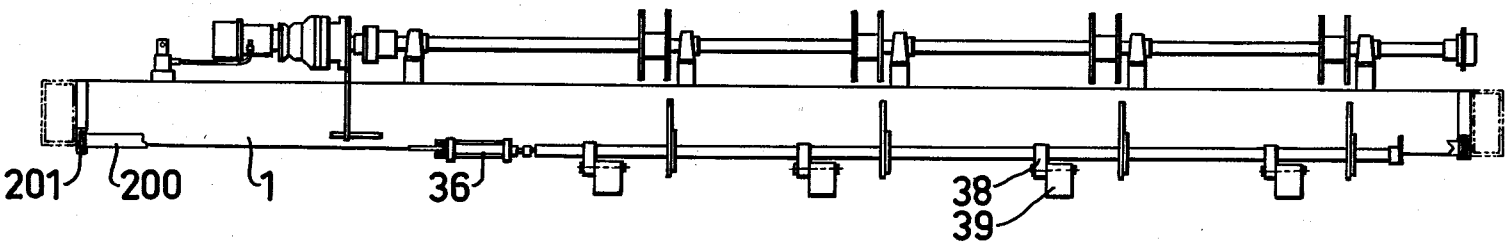

The invention will be illustrated more in detail in connection with the enclosed drawings, in which FIG. 1 shows schematically a vertical section of a wood compartment according to the invention with a carriage belonging to the compartment in a first end position, FIG. 2 shows a section substantially along the line II—II in FIG. 1, FIG. 3 shows schematically the carriage of the compartment in a second end position for insertion of the bands forming the sides and bottom of the compartment into an attaching mechanism, FIG. 4 shows a detail of the attaching mechanism as seen from above, FIG. 5 shows schematically in section the compartment according to FIGS. 1–4 designed as a double compartment, FIG. 6 shows schematically a perspective view of a portion of a modified design of the compartment according to the invention as seen from above, FIG. 7 shows on a larger scale a detail of the compartment according to FIG. 6, FIG. 8 shows on a larger scale a drive mechanism of a supporting beam for the band attaching mechanism included in the compartment according to FIG. 6, FIGS. 9–11 illustrate schematically the function of an additionally modified design of the present wood compartment and shows this in different phase, FIG. 12 shows a top view of the compartment substantially in the phase shown in FIG. 9 and substantially along the line XII—XII in FIG. 9, FIG. 13 shows a section of one end of a band transferring arm included in FIGS. 9–13, and FIG. 14 shows in cross section and on an enlarged scale the friction coupling of FIG. 13.

In the drawings 1 designates cross bars extending across two longitudinal beams 2 in a spaced relationship corresponding to the intended compartment length, which beams are shown in FIG. 2 as supported by poles 2*a*. Between two cross bars 1 there is room for a wood compartment, the bottom and sides of which are formed by a number of flexible support means suitably spaced from each other, which are shown in the form of bands 3 and can be rolled off and onto each band drum 4. These band drums 4 are fixed on a common shaft 5, which is driven by a motor 6 via a brake 6*a*, a coupling 7 and a gear 8. The gear is connected by a moment arm 9 with a carriage 10, which also supports the shaft 5 by means of brackets 12 provided with bearings 11. Such a carriage 10 is arranged in each wood compartment of the type shown in FIGS. 1–6.

The framing of the carriage 10 consists of a beam 13, which at its ends is designed or provided with sliding shoes 14 to run on sliding surfaces or treads 15 of the longitudinal beams 2, which should have an I-profile therefor, as is apparent from FIG. 2, but of course any other suitable beam profile may be used. To reduce the friction between the running surfaces 15 of the beams and the sliding shoes 14 of the carriage said running surfaces and/or sliding shoes may be provided with suitable sliding pads 16. Instead of sliding shoes the carriage 10 can of course be provided with wheels. Each carriage 10 is arranged to move between the cross bars 1 of its compartment, and the drive of the carriage can be carried out in several various ways dependent on or independently of the drive of the shaft 5.

In the design according to FIGS. 1–6 the drive of the carriage 10 from the shaft 5 takes place via a chain or belt transmission 17 at each carriage end. Each such transmission 17 comprises a drive wheel 18 attached to the shaft 5, a chain 19 or a belt and a driven wheel 20 attached to a shaft 22 mounted in bearing brackets 21 suspended at the carriage framing 13. Moreover, on this shaft a chain wheel 23 for a finite drive chain 24 is attached, which extends below the chain wheel 23 and then upwards over pulleys 25 arranged on both sides thereof and supported by the carriage up to and above pulleys 26 rigidly arranged relative to the beams 1 and 2 and located in a spaced relationship from each other corresponding to the way of motion of the carriage or rigid sliding bows, preferably of plastic, from which the chain 24 hangs down with its end portions. In these end portions stops 27 are attached which serve as weights, the distance between these stops being adjustable according to needs.

The stops 27 are arranged to coact with each of their rigid stops 28 for locking the chain and consequently for displacement of the carriage 10. Thus, when the right stop 27 in FIG. 1 makes contact with its fixed stop 28 and the shaft 5 is driven in the direction shown by the arrow 29 the carriage 10 is brought to move by the drive wheel 23 coacting with the finite and thus locked drive chain 24 from its end position, shown in FIG. 1 by means of full lines, to its second end position only shown by certain dashed profile lines and in an opposite direction, when the left stop 27 in FIG. 1 bears against its fixed stop 28 and the shaft 5 is driven in an opposite direction to the arrow 29. When none of the stops 27 of the finite drive chain bears against a stop 28 the drive chain 24 is fed after in one or the other direction depending on the rotational direction of the shaft 5 and the carriage 10 then remains in one of its end positions. In order that the drive chain 24 should not be fed down between the pulleys 25 and 26 (see FIG. 1) the weight of the stop 27 and/or the portion of the chain hanging from a pulley 26 should be such that it maintains the chain stretched between the pulleys 25 and 26, which could preferably turn freely relative to their shafts 30. It should, however, be pointed out that it is also possible to let the drive chain be fed down between the pulleys 25 and 26 on each side of the carriage 10.

The bands 3 forming a compartment are, as mentioned above, preferably wound to each respective drum 4 attached to the shaft 5, and more specifically in such a way that the bands are unwound from the respective drums when the shaft 5 is turned in one direction, e.g. in the direction marked by the arrow 29 and wound on when the shaft 5 is turned in the other direction. Each band 3 is secured to its drum 4 with one of its ends and has its other end in the form of an attaching means 31, which is shown in the drawings as formed by folding of the end portions of the band around a body 32 with a round, wedge-shaped or other suitable cross sectional profile and with a length which should not be greater than the band width and the interconnection of the band portions 33 lying on each other and the body 32. The attaching means 31 should be as small as possible in order not to prevent pulling out of the band after emptying the compartment.

The bands 3 in a compartment are with their attaching means 31 detachably suspended in an attaching mechanism comprising a shaft 35 arranged parallelly to the cross bars and close to one of two cross bars of a compartment, which shaft is displaceable by means of a piston-cylinder arrangement 36 in its longitudinal direction and is simultaneously pivotally supported on said cross bar 1. A number of band holders or locking members 37 corresponding to the number of bands 3 are fixed to this shaft 35. Each of these locking pieces 37 comprises an arm 38 fixed to the shaft 35, and a locking tongue or holding means 39 supported by this arm and parallel to the shaft 35, which tongue forms a gap 40 between itself and the shaft 35 with a width less than the thickness or width of the attaching means 31 of the bands. In attached position, as is shown in FIG. 1, the attaching means 31 of the band is supported by the shaft 35 and the locking tongue 39 of the locking member, and there is no possibility that it can be pulled down through the gap 40, as the attaching means 31 of the band is wider than the gap 40.

For loosening the attaching means 31 of the bands from the attaching mechanism at emptying of a compartment the shaft 35 is moved in the direction shown by the arrow 41 in FIG. 4 and then the locking tongues 39 of the locking members are brought to leave the band ends and the attaching means 31 which are then released and fall down. In order that such a displacement of the shaft 35 should not be brought along a side support 42 for each band is arranged, which support is attached to the cross bar 1 and serves as bearing bracket for the shaft 35, said support having through holes 43 for the shaft 35 and a stop surface 44 located in the gap 40 preventing the band 3 from moving along the shaft 35 in the direction marked by the arrow 41.

Starting from FIG. 1 showing a compartment according to the invention which is filled with wood from an overhead hook conveyor 46 indicated only schematically and in a position to empty its contents of wood on an underlying conveyor 47 indicated only schematically, the function of the compartment according to FIGS. 1–6 will be described in the following more in detail. In the filled position shown in FIG. 1 by means of continuous lines the bands 3 forming the compartment thus hang like a U from their drums 4 and the attaching mechanism, in which the free ends 31 of the bands are maintained immovably fast. By turning the shaft 5 and consequently the band drums 4 in the direction marked by the arrow 29 band is wound off the drums 4, and the compartment can be lowered from said position to an emptying position shown schematically by means of a line of short dashes for delivering its contents onto an underlying conveyor 47, and as soon as the bands 3 are unloaded the piston-cylinder arrangement 36 can be brought by a guide means known per se and not shown in detail in the drawings to move the shaft 35 and consequently the locking members 37 in the direction shown by the arrow 41 to detach the band ends 31, which will then fall down, and the wood contents of the compartment are placed on the conveyor 47.

At the same time as a band is rolled off the drums 4 for lowering the compartment the drive chain 24 is fed over from the right to the left side in FIG. 1, and when the right stop 27 of the chain will thus bear against the fixed stop 28 the feeding of the drive chain 24 is stopped, but at the same time the carriage 10 starts instead to move to its other end position. Before the carriage 10 reaches this end position it will with a carrier 49 get in contact with a swivel arm 50 fixed to the shaft 35 and, more specifically, with a projection 51 connected with the swivel arm, and will thus bring along this projection 51 in its continued motion up to its end position, the shaft 35 being turned to such an extent that the locking tongues 39 are swung to a position in front of the shaft 35, as is apparent from FIG. 3. In this phase the locking members 37 are still displaced from the respective band position, and the hanging bands 3 are thus moved by the carriage 10 to contact with the shaft 35, the surface of which facing the bands should be at a greater distance e.g. from the cross bar 1 shown in FIG. 3 than the surface of the carriage beam 13 being in the end position and facing said cross bar and the bands 3 so that the bands 3 are kept with certainty in contact with the shaft 35 when the carriage 10 has reached its end position shown in FIG. 3. The piston-cylinder arrangement 36 is then brought by some known guide means to move the shaft 35 against the direction shown by the arrow 41, and in this way the locking tongues 35 of the locking members are also displaced over and to a position in front of the respective band 3, as shown in FIG. 4. In order that the bands 3 should not be brought out of their position a guide flange 52 is arranged for each band on the side 53 of the carriage beam 13 facing the bands. Each band 3 is now kept guided in its gap 40 and cannot leave this.

After the locking tongues 39 of the locking members have been returned to their position shutting up the bands, uncoiling of the bands 3 can be started. The motor 6 is then connected turning the shaft 5 in the direction marked by the arrow 54 in FIG. 3 and in this way the bands are wound onto the respective band drum 4. The free band ends do not offer any direct resistance thanks to their smallness and cannot stick, either, in anything at uncoiling due their closed form.

Simultaneously with uncoiling of the bands 3 a transfer of the drive chains 24 from the left to the right in FIG. 1 takes place by the transmissions 17 and the drive wheels 23, and, thus, when the left stops 27 on the drive chains 24 are stopped against the fixed stops 28, the carriage 10 is brought to move towards its first end position marked by continuous lines in FIG. 1 and releases the projection 51 of the swivel arm, which will thus have such a length that it makes contact with the end surface of the carrier designated by 55 even after the displacement of the shaft 35 and consequently the locking tongues 39 to the position shown in FIG. 4, which end surface, in its turn, should have a vertical extension at least corresponding to the height of the bow described by the projection 51 at its motion between the end positions.

After releasing the projection 51 the shaft 35 of the attaching mechanism can turn freely a certain angle and adjusts itself to the bands 3 being coiled on the drums, which bands will then run over the gently bow-shaped support surface 56 of the locking tongues and which by the motion of the carriage to said first end position are also drawn over the compartment to form its bottom. Immediately before the carriage 10 reaches its first end position the band ends will enter their respective gap 40 and the attaching means 31 will lock the same in the attaching mechanism in a previously indicated way. During the continued motion of the carriage to the end position the bands 3 will be stretched and in this way possible differences in length are balanced, whereby the bands will always be on the same level when the carriage 10 has entered its first end position, which can be sensed by some means known per se for interrupting the drive of the shaft 5. After this the rotational direction of the shaft is reversed for rolling bands off the drums 4 at the rate at which the compartment is filled, and this off-rolling of bands can be controlled in some way known per se by using means sensing the level.

It should also be mentioned that it is possible, by the arrangement of a friction coupling or another coupling releasing at a pre-determined moment in each transmission 17 and fixed end stops 58 for the carriage 10 in its first end position, merely by coiling of the bands onto the band drums to stretch the same to an extent required to balance possible differences in length, even after the carriage 10 has entered its end position defined by the end stops 58.

In the above the band compartment according to the invention has been described as a single-compartment, but the present compartment can also be designed as a double compartment, as is apparent from FIG. 5. The carriage 10 is then provided with double sets of bands and band drums, i.e. one set of bands and band drums for the filled compartment 60 located to the left of the carriage 10 in FIG. 5, the bands 61 of which are attached to an attaching mechanism 62, and one set of bands and band drums for the compartment 63 being filled and located to the right of the carriage 10 in FIG. 5, the bands 64 of which are attached with their free end to an attaching mechanism 65. All the band drums are individually movably mounted on the shaft 5 and are according to the embodiment only shown as an example in FIG. 5 designed or provided with a gear ring 66 at their periphery for their drive. More specifically, the band drums associated with the compartment 60 are driven by gear wheels 68 fixed to a shaft 67 driven in the same way as the shaft 5 in the embodiment according to FIGS. 1–4, and the band drums associated with the compartment 63 by fixed gear wheels 70 driven by a shaft 69 e.g. in the same way as said shaft 5 but independently of the shaft 67, said gear wheels thus engaging the gear ring 66 of the respective band drums. By this separate drive of the band drums of the compartments the two compartments 60 and 63 can thus be filled and emptied almost independently of each other.

For displacement of the carriage 10 a separate drive means 71, which is thus not dependent on the drive of the band drum, is arranged, said means comprising a chain 72 attached between the cross bars 1, which chain is drawn around a chain wheel 73, which is attached to an output around a chain wheel 73, which is attached to an output shaft of a motor not shown in detail via pulleys 74 located on both sides of the chain wheel 73 and supported by the carriage 10. The drive motor of the carriage is controlled by guide means not shown in detail, so that the carriage 10 can be automatically brought to stop in certain positions, e.g. in the two end positions and in the position which the carriage is shown to enter in FIG. 5 and the corresponding position at the other side of the compartment.

Emptying of the compartments 60 and 63 and a following connection of the bands of the emptied compartment to the attaching mechanism are carried out in the same way as at the simple compartment described above with the only difference that the balanced pulling of the bands is made directly by means of the band drums, which is made possible thanks to the separate drive of the carriage. Such a separate operation can also be utilized for the carriage in the simple compartment.

In FIGS. 6–8 a modified design of the present compartment is shown, which differs from the compartment according to FIGS. 1–5 in that the band attaching mechanism is arranged at a displaceable beam instead of the band drums 4, which are arranged with their shaft 5 and motor 6 on one of the fixed cross bars 1 of the compartment. In these figures the corresponding parts are designated by the same reference numerals as in FIGS. 1–5.

The bands 3 of the compartment are together with the attaching means 31 detachably suspended in each their band holder 37 of the attaching mechanism which are arranged in this embodiment at a support beam 100 movable between the fixed cross bars 1 of the compartment.

The support beam 100 rests at both of its ends with wheels or sliding feet 101, as shown in FIG. 6, on treads or sliding tracks 102 located on either side of the framing. These tracks can be arranged on separate beams attached to the longitudinal beams 4 or directly on these longitudinal beams 2. The support beam 1 is parallelly displaceable on these sliding tracks between the fixed cross beams 1 and this parallel displacement is achieved by means of connecting rods 103 arranged at each longitudinal beam 2, which rods are guided in guide clamps 104 or the like attached to the beams and which are connected via a gear mechanism to each of their drive means in the form of e.g. a double-acting piston-cylinder device synchronized with each other. Each gear mechanism is shown to comprise a short moment or swivel arm 107 fixed to a shaft 106, on which arm the piston-cylinder device 105 articulatedly connected to the framing acts, and a longer moment and swivel arm 108 fixed to the same shaft 106 as the short swivel arm 107, said arm 108 being articulatedly connected with its connecting rod 103 via a link 109. This gear mechanism can be arranged under the connecting rod 103, as shown in FIG. 8, or above the connecting rod 103, as shown in FIG. 6. By these gear mechanisms it is achieved that the connecting rods 103 can be moved a long way with a piston-cylinder arrangement having a short piston travel and the connecting rods should thus be displaced a distance approx. corresponding to the distance between the fixed cross bars 1 for displacement of the supporting beam between its two outer positions, one of which is shown in FIG. 6 with continuous lines, and the other outer position of the supporting beam is shown schematically in FIG. 8.

For connecting the support beam 12 of the respective compartment with the connecting rods 103, which are therefore provided with a pair of carrier projections 110 for each compartment which are suitably spaced, each supporting beam is at its two ends provided with a double-armed locking member 112 pivotally mounted around a shaft 111, which locking member is operated by means of an operating means 113 placed in or at the beam, which means is shown in FIG. 7 in the form of a piston-cylinder arrangement.

The locking member 112 is at one of its ends designed as a locking hook 114, which coacts in locking position with at least one locking lip 115 attached to the longitudinal beam to prevent the support beam 100 from moving towards the cross bar 1 supporting the band drums 4 owing to the forces that the wood pieces supported by the bands 3 can exert on the support beam 100. At its other end each locking member 112 is provided with a connecting lip 116 which is arranged, for connection of the support beam 100 to the connecting rod 103 to be pivoted in between the carrier projections 110 on the connecting rod, i.e. to the position shown in FIGS. 6 and 7, by its operating means 113, and simultaneously with this the hook 115 of the locking member is brought out of its locking position to release the support beam 100 from the longitudinal beams 2. After this the support beam 100 thus released and connected with the connecting rods can be displaced parallelly along the sliding tracks 102 and e.g. to its second outer position by the connecting rods 103 shown in FIG. 8 e.g. for hooking of the band ends loosened for emptying of the compartment in the band holders 37 of the band attaching mechanism, after which the support beam 100 is returned by means of the connecting rods 103 to the outer position shown in FIG. 7 and locked in this position by the hooks of the locking members arranged at the ends of the support beam being swung down behind the locking lip 115 by means of the operating means 113. Thereafter the connecting rods 103 can be used for displacement of the support beam 100 of another compartment in a similar way and the connecting rods are thus arranged to serve more than one compartment.

By arranging several locking lips 115 at the longitudinal beams 2 the support beam 100 can be set in different positions and therefore the width of the compartment opening can also be changed according to needs. In the cases when the running tracks 102 are designed on a separate beam at the longitudinal beams 2 the locking position or positions of the hook 114 of the locking members can consists of lock position holes arranged in the upward surface of this separate beam.

When the compartment 1 is to be emptied its contents are lowered e.g. onto said underlying transport means by winding bands off the band rolls 4. After this the shaft 35 of the band attaching mechanism is moved in the direction shown by the arrow 41 to the required extent to remove the holder means 39 from the respective band 3. Then the bands can be wound onto the band drums 4 and the support beam 100 supporting the band attaching mechanism can be displaced by means of the connecting rods 103 to the end position shown in FIG. 8, in which the bands 3 hanging from the band drums 7 will bear against the shaft 35 of the attaching mechanism and simultaneously the shaft 35 is brought in the previously indicated way to turn a certain angle for upward turning of the holder means 39 so that a maximum width is imparted to the gap 40 between these and the shaft 35 as seen in horizontal projection. As soon as the support beam has entered the end position shown in FIG. 8 the shaft 35 of the attaching mechanism is displaced to move the holder means 39 over the respective band and to enclose these in the respective band holder 37. After the bands 3 have been enclosed in the respective band holder the support beam 100 can be returned to the end position shown in FIG. 6 by means of the connecting rods 103 or remain until the bands 3 have been unwound so that their attaching means 3 are positioned in and retained by the band holders 37, and be returned only after this to its starting position shown in FIG. 6, in which the beam is locked by means of the hooks 114 of the locking members. By this movable support beam supporting the band attaching mechanism it is achieved that the compartments can be rapidly restored and by the band holders it is also possible to balance certain differences in length so that all the bands are on the same level after restoring the support beam 100 to the position shown in FIG. 6.

In FIGS. 9–14 an additional embodiment of the present compartment is shown, at which the shaft 5 supporting the band drums 4 and the band attaching mechanism are arranged at either of the cross bars 1 of the compartment and at which the transfer of the bands 3 from a hanging position after loosening the band ends 31 from the drums 4 to the band transferring position shown in FIG. 10 is effected by means of a transferring arm 200. Also in FIGS. 9–14 the corresponding parts are designated by the same reference numerals as in the other figures.

The band transferring arm 200 is arranged between the cross bars of the compartment and is guided displaceably at its ends by U-shaped guides 201, which in the embodiment shown extend obliquely upwards from the cross bar of the compartment supporting the band drums 4 to the cross bar supporting the band supporting mechanism (FIGS. 9–11). Each such guide is along its lower flange 202 provided with a chain 203 or rack connected thereon for coaction with a chain wheel 204 or gear arranged on the respective arm end. One of the chain wheels of the arm is drivably connected with the shaft supporting the band drums by a chain 205, which extends between pulleys 206 through the guide and is there drivingly engaged with the chain wheel of the arm and which is driven by a chain wheel 207 attached to the shaft 5, by which it is kept in driving engagement by a pulley 208 in such a way that the band transferring arm is displaced in the direction marked by the arrow 209 in FIG. 10 when bands are rolled off and in an opposite direction when bands are rolled onto the drums 4.

Figure 14:
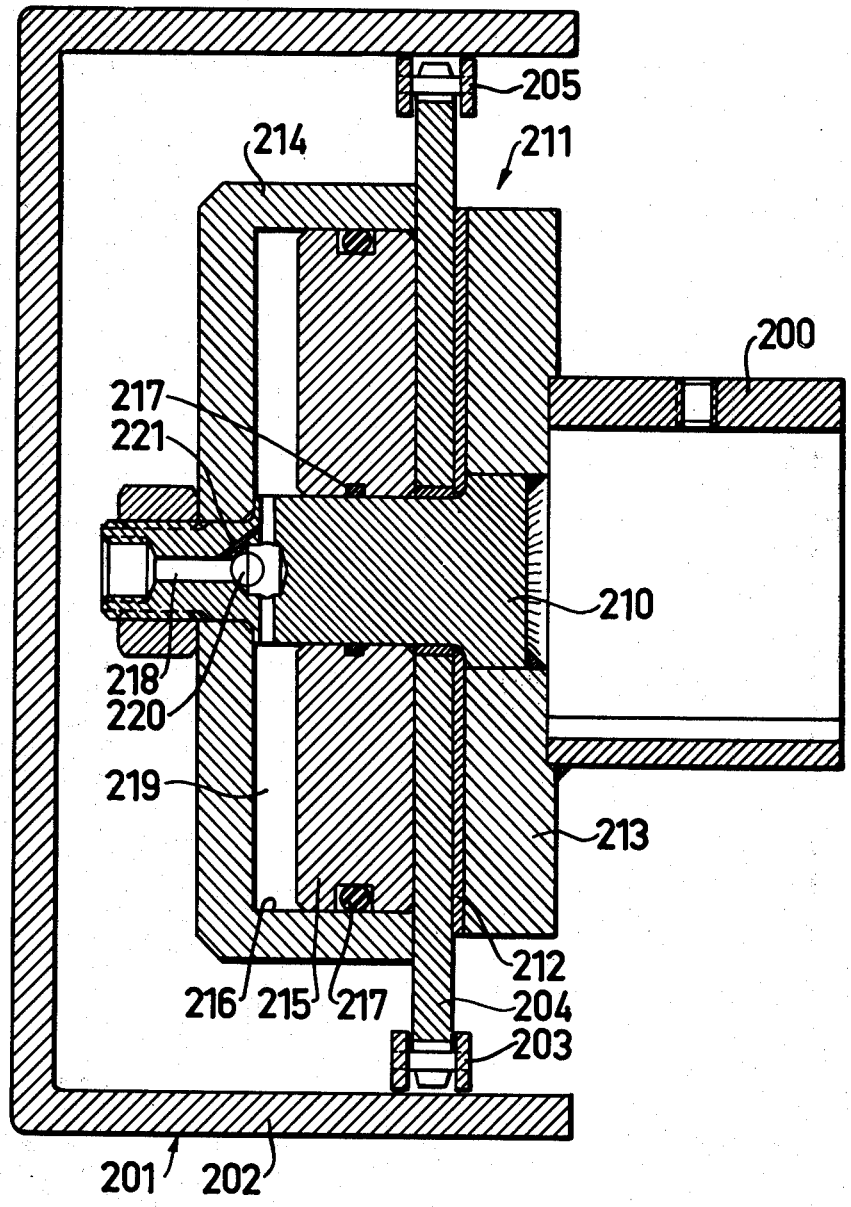

The chain wheel 205 of the band transferring arm drivable by the chain 205 is mounted freely movable on a shaft journal 210 connected with the arm but for displacement of the arm 200 it can be connected with this by a pressure-medium operated friction coupling 211 shown more in detail in FIG. 14. This coupling comprises friction pads 212 arranged on the chain wheel 204 or a clutch disc 213 connected with the shaft journal and/or the arm and a piston 215 movable on the shaft journal in a housing 214, which piston is sealed against the shaft journal and the cylinder wall 216 of the housing by means of seals 217. For supply of pressure medium a channel 218 is arranged in the shaft journal and connected to a pressure medium source via a conduit not shown in detail in the figures, which channel leads into the space 219 behind the piston and comprises a nonreturn valve 220 by which a by-pass channel extends.

Thus, at a pressure-influenced piston the friction coupling 211 is connected and owing to this the band transferring arm 200 is displaced by the chain 205 in one direction or the other depending on the rotational direction of the shaft 5. As soon as the pressure in the conduit to the friction coupling ceases, the nonreturn valve 220 is closed and the pressure acting on the piston is then maintained for a certain intended time decided by the cross-sectional area of the by-pass channels in order to end at last, and the friction coupling 211 is then disconnected and the drive connection between arm and chain wheels is completely interrupted.

As pressure medium source of the frictional coupling 211 the piston-cylinder arrangement 36 can preferably be utilized in such a way that it introduces pressure medium via the conduit connected to the channel 218 and not shown in the drawing in detail, e.g. air, under pressure, when it is brought to displace the shaft 35 of the band attaching mechanism in the direction shown by the arrow 41 to open the band holders 37 and to loosen the bands 3 from the attaching mechanism.

When the piston-cylinder arrangement then displaces said shaft 35 in an opposite direction for closing the band holders, the pressure in the conduit to the friction coupling 211 will be reduced, the nonreturn valve 220 being closed and the bypass channel 211 starting to operate so that the friction coupling 211 is disconnected after the transferring arm 200 has been returned from the position in FIG. 10 to its starting position shown in FIG. 11.

At emptying of a compartment its wood contents are lowered down to the underlying transport device 47 by bands 3 being rolled off the drums 4 and then the band attaching mechanism is opened in a way as indicated above for loosening the band ends 31. At the same time as this the friction coupling 211 of the transferring arm is connected through the piston-cylinder arrangement 36, and since band is still being rolled off, the arm 200 will be displaced by the chain 205 driven by the shaft 5 along its guides 201 in the direction marked by the arrow 209 and consequently bring the bands 3 hanging from the band drums to the band transferring position shown in FIG. 10. Before the arm enters this position it is brought from below into contact with a swivel arm 222 connected with the shaft 35 (FIGS. 12 and 13) in order to turn the shaft 35 during its continued motion, and the holder means 39 attached thereon from the position shown in FIG. 9 to the position shown in FIG. 10 and thus to prepare the band holders 37 for a reception of the bands 3.

When the transferring arm 200 enters its band transferring position in which the bands make contact with the shaft 35 and the friction coupling 211 is allowed to slip, the piston-cylinder arrangement 36 is connected manually or automatically to close the band holders 37 by displacing the shaft 35 and consequently the holder means 39 over the bands, which are then enclosed in the relative band holder. At the same time a pressure decrease is achieved in the conduit to the friction coupling 21' so that its nonreturn valve 220 is closed and the by-pass channel 221 starts to operate for a successive reduction of the pressure in the piston 215.

At the same time as the transferring arm 200 enters its band transferring position it also actuates guide means not shown in greater detail which cause reversion of the rotational direction of the shaft 5 for coiling of the bands 3 onto the drums 4, and in this way the direction of motion of the chain 205 is also changed so that the transferring arm 200 is returned to its starting position shown in FIG. 11. When it has entered this position the friction coupling 211 has also been disconnected so that coiling of the bands 3 can continue without the transferring arm being actuated and until the attaching means 31 enter the band holders 37 and are locked, after which the rotational direction of the shaft 5 is again changed for lowering the bands at the rate at which the compartment is filled.

What we claim is:

1. Apparatus for handling elongated objects such as pieces of wood includes at least one elongated flexible member for forming the bottom and sides of an object-handling compartment having a longitudinal dimension and a transverse dimension, said flexible member having a first end and a free end; coiling means associated with said first end of said flexible member for winding up and unwinding said flexible member; attaching means at said free end of said flexible member; an attaching mechanism operable for selectively being connected to and disconnected from said attaching means whereby when said attaching means and said attaching mechanism are connected, said flexible member can be suspended from its ends to form said compartment and whereby said attaching means can be disconnected from said attaching mechanism to loosen said flexible member to enable emptying of the compartment; and means arranged after loosening of the flexible member to introduce the flexible member in the attaching mechanism so as to bring the attaching means by winding of the flexible member onto the coiling means, to retaining engagement with the attaching mechanism, said attaching mechanism including a bifurcated holder for said flexible member, said holder being displaceable relative to said flexible member in the longitudinal direction of the compartment to loosen said flexible member when displaced in one direction, and to straddle the flexible member after introduction thereof into the attaching mechanism, when displaced in the opposite direction, so as to allow for the attaching means to be brought by winding of the flexible member onto the coiling means, to its retaining engagement with the attaching mechanism.

2. Apparatus as in claim 1 wherein said holder is arranged on a shaft which is displaceable in the longitudinal direction of the compartment, said holder forming between itself and said shaft a laterally open gap having a width less than the thickness of said attaching means so that when said flexible member resides in the gap said holder prevents said attaching means from moving through the gap.

3. Apparatus as in claim 2 wherein said shaft is pivotally supported.

4. Apparatus as in any one of claims 1, 2, or 3 wherein said coiling means includes a drum arranged on a shaft which is reversibly rotatable.

5. Apparatus as in claim 5 wherein said drum-supporting shaft is mounted on a carriage movable transversely of the compartment, said carriage carrying the means for the introduction of the loosened flexible member into said attaching mechanism.

6. Apparatus as in claim 1 wherein said attaching mechanism is arranged on a carrying means movable transversely of the compartment, said carrying means being the means for the introduction of said flexible member into said attaching mechanism.

7. Apparatus as in claim 6 wherein said carrying means includes an elongated support arm extending longitudinally of said compartment and supporting said attaching mechanism, at least one locking hook for locking said support arm in at least one position in which said flexible member forms a compartment and piston and cylinder means for moving said support arm transversely of itself.

8. Apparatus as in claim 1 wherein said means for introduction of said flexible member in said attaching mechanism includes a transferring arm movable between said attaching mechanism and said coiling arm.

9. Apparatus as in claim 8 including guides for the ends of said transferring arm and means for driving said transferring arm in dependence on rotation of said coiling means.

10. Apparatus as in claim 9 including a friction coupling between said drive means and said transferring arm, said coupling being operable in dependence on the operation of said attaching mechanism to connect and disconnect said drive means and said arm.

* * * * *